US008438959B2

(12) United States Patent
Brussel

(10) Patent No.: US 8,438,959 B2
(45) Date of Patent: May 14, 2013

(54) CUTTING DEVICE FOR SHEAR-CUTTING OF FIBRE STRANDS

(75) Inventor: Richard Brussel, Sulzfeld (DE)

(73) Assignee: MAG IAS, GmbH, Goppingen (DE)

( * ) Notice: Subject to any disclaimer, the term of this patent is extended or adjusted under 35 U.S.C. 154(b) by 273 days.

(21) Appl. No.: 13/028,319

(22) Filed: Feb. 16, 2011

(65) Prior Publication Data

US 2011/0203433 A1 Aug. 25, 2011

(30) Foreign Application Priority Data

Feb. 24, 2010 (DE) ..... 10 2010 002 271

(51) Int. Cl.
*B23Q 15/00* (2006.01)
*B26D 1/143* (2006.01)

(52) U.S. Cl.
USPC ..... 83/74; 83/504; 83/913; 83/950

(58) Field of Classification Search ..... 83/72, 74, 83/504, 507, 508, 508.2, 561, 580, 658, 659, 83/913, 950, 679, 694
See application file for complete search history.

(56) References Cited

U.S. PATENT DOCUMENTS

| | | | | |
|---|---|---|---|---|
| 3,708,129 | A * | 1/1973 | Nowak | 241/189.1 |
| 3,889,520 | A * | 6/1975 | Stoferle et al. | 73/37.5 |
| 4,924,713 | A * | 5/1990 | Machino et al. | 73/862.06 |
| 5,278,620 | A * | 1/1994 | Godlove | 399/71 |
| 5,836,225 | A * | 11/1998 | Molnar et al. | 83/100 |
| 6,209,432 | B1 * | 4/2001 | Matsuda | 83/342 |
| 6,247,388 | B1 * | 6/2001 | Carter et al. | 83/13 |
| 6,599,178 | B1 * | 7/2003 | Gluche et al. | 451/540 |
| 6,745,656 | B1 * | 6/2004 | Shen et al. | 83/105 |
| 7,152,514 | B2 * | 12/2006 | Bascom et al. | 83/109 |
| 7,703,362 | B2 * | 4/2010 | Kempski et al. | 83/13 |
| 7,946,357 | B2 * | 5/2011 | Trinh et al. | 175/50 |
| 8,166,857 | B2 * | 5/2012 | Powell et al. | 83/30 |
| 2002/0088324 | A1 * | 7/2002 | White et al. | 83/73 |

(Continued)

FOREIGN PATENT DOCUMENTS

| | | | |
|---|---|---|---|
| DE | 2745610 | A | 4/1979 |
| DE | 10242553 | A1 | 10/2003 |
| DE | 102007052587 | A1 | 5/2009 |
| WO | 2009056259 | A1 | 5/2009 |

OTHER PUBLICATIONS

EP 11 15 3506 Search Report, dated Jun. 24, 2011, 1 page.

(Continued)

*Primary Examiner* — Sean Michalski
(74) *Attorney, Agent, or Firm* — Reising Ethington P.C.

(57) ABSTRACT

A cutting device for shear-cutting of fiber strands comprises at least two cutting units which are rotatably drivable about an axis of rotation and two counter cutting units which are rigidly mounted relative to a base frame. The cutting edges of the cutting units as well as the counter cutting edges of the counter cutting units are positionable relative to a common cutting plane independently of each other. The forces acting on the counter cutting edges are measured during a cutting process by means of corresponding measuring sensors, allowing the position of the counter cutting edges to be controlled by means of a control unit via electrically driven displacement devices.

16 Claims, 4 Drawing Sheets

U.S. PATENT DOCUMENTS

2002/0104420 A1* 8/2002 Bascom et al. ..... 83/665
2003/0205117 A1* 11/2003 Flaherty et al. ..... 83/13
2008/0009697 A1* 1/2008 Haider et al. ..... 600/407
2010/0038136 A1* 2/2010 Trinh et al. ..... 175/40
2010/0287737 A1 11/2010 Brussel
2011/0178542 A1* 7/2011 Smith et al. ..... 606/169
2011/0230868 A1* 9/2011 Isobe et al. ..... 606/1
2012/0192687 A1* 8/2012 Iguchi et al. ..... 83/13
2012/0312599 A1* 12/2012 Trinh et al. ..... 175/57

OTHER PUBLICATIONS

German Examination Report of DE 10 2010 002 271.3-26, Dated Sep. 30, 2010, 4 pages.

* cited by examiner

CUTTING DEVICE FOR SHEAR-CUTTING OF FIBRE STRANDS

BACKGROUND OF THE INVENTION

1. Field of the Invention

The invention relates to a cutting device for shear-cutting of fibre strands.

2. Background Art

DE 10 2007 052 586 A1 discloses a cutting device which cuts endless fibres into staple fibres. The cutting device comprises two blades mounted to a rotating cutting spindle which are coupled to each other via a positive fit coupling and alternately act as compensation weights for compensating the centrifugal forces occurring during operation. The cutting units are assigned to two cutting units which are rigidly arranged on a base frame, thus causing the endless fibres disposed between the cutting units to be cut into pieces when the cutting spindle is rotating. The number of cutting units allows a high throughput to be achieved. The drawback of this cutting device is that the cut quality of the fine endless fibres to be cut is unsatisfactory.

SUMMARY OF THE INVENTION

It is the object of the invention to provide a cutting device for fibre strands which ensures a constantly high cut quality and a high fibre strand throughput at the same time.

This object is achieved by a cutting device for shear-cutting of fibre strands comprising a base frame; at least two cutting units which comprise in each case a blade with a cutting edge, with a first cutting edge defining a cutting plane; and a second cutting edge being displaceable and positionable in the cutting plane independently of the first cutting edge, which are arranged at a cutting spindle mounted to the base frame, the cutting spindle being rotatably drivable about an axis of rotation which is perpendicular to the cutting plane; at least two counter cutting units; which comprise in each case a counter blade with a counter cutting edge, with the counter cutting edges being displaceable and positionable in the cutting plane independently of each other by means of a respective electrically driven displacement device; and a force acting on the respective counter cutting edge being detectable as a measuring signal by means of a respective measuring sensor; and which are rigidly arranged at the base frame about the axis of rotation; at least two fibre supply units for supplying fibre strands between the at least two cutting edges and the respectively associated counter cutting edges; and a control unit which is configured in such a way that depending on the associated measuring signal, each of the counter cutting edges is displaceable relative to the cutting plane by means of the respective electrically driven displacement device. The at least two rotating cutting units and the at least two stationary counter cutting units assigned thereto ensure a high cutting performance and therefore a high fibre strand throughput. In order to provide for a constantly high cut quality at such a high cutting performance, the cutting edges of the blades of the rotating cutting units need to be positionable in the cutting plane individually, in other words independently of each other. In addition to that, the counter cutting edges of the stationary counter blades need to be positionable in the cutting plane independently, in other words independently of each other and independently of the cutting edges of the rotating blades. In order to ensure a constantly high cut quality during the operation of the cutting device, the position of the counter cutting edges is controllable, with the result that the counter cutting edges are always disposed within a small tolerance range about the cutting plane, or ideally, always in the cutting plane determined during blade standstill. To this end, a measuring sensor is arranged for each counter cutting edge in such a way that a force acting on the respective counter cutting edge is detectable as a measuring signal during the cutting process and transmittable to a control unit. Preferably, the measuring sensors are used to determine a spreading force which acts on the counter cutting edges perpendicularly to the cutting plane. Based on the measuring signal, the control unit performs a nominal-actual value comparison for each of the counter cutting edges and actuates an associated electrically driven displacement device depending on the measuring signal or the nominal-actual value comparison. The electrically driven displacement device displaces the respectively associated counter cutting edge in such a way that the counter cutting edge is displaced to the desired position so as to be located within a tolerance range about the cutting plane or in the cutting plane determined during blade standstill. Thus a separate control circuit consisting of a measuring sensor, electrically driven displacement device and control unit is formed for each counter cutting edge, the control circuit allowing the position of the counter cutting edge to be controllable individually and accurately. This particularly allows thermal expansions and/or a wear of the cutting edges and/or counter cutting edges to be compensated for which would otherwise impair the cut quality. This ensures a constantly high cut quality during the entire operation of the cutting device or until the blade needs to be replaced.

A cutting device where the measuring sensors are piezoelectric ensures an accurate control of the position of the counter cutting edges. The piezoelectric measuring sensors provide a high measuring accuracy and a high measuring speed at the same time. The measuring sensors are for example designed as piezoelectric quartz sensors.

A cutting device where by means of the measuring sensors, a force is measurable which acts on a respective one of the counter blades in the z-direction, with the z-direction being perpendicular to the cutting plane, allows the position of the counter cutting edges to be controlled easily by means of the measured spreading force. By means of a control algorithm implemented in the control unit, the spreading force is adapted until the blade needs to be replaced. The control algorithm includes the measured spreading force which acts on the respective counter blade without and with a fibre strand being disposed between the blades as well as a required increase of the nominal spreading force during the cutting process in order to maintain a desired fibre cut quality over the blade service life. Information about the fibre cut quality may be provided manually or automatically via a corresponding assessment system. The assessment system may for instance be an optical assessment system. The control algorithm includes a standard course of the nominal spreading force over the blade service life according to which the respectively measured spreading force is adjusted as well as a spreading force threshold value which indicates that the blade needs to be replaced. The standard course of the nominal spreading force and of the spreading force threshold value are determined as a function of the fibre parameters such as tex weight, filament diameter, fibre material, number of the fibre strands as well as the blade parameters such as blade geometry, blade material, and the cutting parameters such as cutting speed and fibre length. Moreover, an automated cut quality assessment, which is in operation permanently or cyclically, allows the respective spreading force to be influenced via the blade service life. The spreading force is adjustable according to the standard course by displacement of the respective counter blade using the associated electrically driven adjustment device, which results in an optimized cut quality.

A cutting device where by means of the measuring sensors, a force is measurable which acts on a respective one of the counter blades in an x-direction and/or a y-direction, with the x- and y-directions being parallel to the cutting plane, allows worn-out blades and/or counter blades to be detected. The cutting force acting on the respective counter blade in a direction which is substantially parallel to the cutting plane becomes higher and higher depending on the wear of the blade or counter blade. If the measured cutting force exceeds a predefined threshold value in one of the x- and y-directions, then an unacceptable wear of the blades is detectable by means of the control unit. The blades and/or counter blades can then be replaced by new or sharpened blades or counter blades. When the blades become blunt over their service life, then the nominal spreading force usually needs to be increased in order to achieve or maintain the desired cut quality.

A cutting device where the measuring sensors are in each case arranged between the counter blade and the electrically driven displacement device ensures an accurate measurement as the measuring sensors are arranged close to the associated counter blades. The measuring sensors are preferably arranged between the respective counter blade and a fork-shaped and elastic connection member which forms a pivot axis for the counter blade.

A cutting device where the displacement devices each comprise a fork-shaped and elastic connection member to which the respective counter blade is mounted and displaceable relative to the base frame about a pivot axis ensures a continuous and precise adjustment of the position of the counter blades. The fork-shaped and elastic connection members form in each case a pivot axis which is substantially parallel to the cutting plane, with the result that the position of the counter blades at the distance to the cutting plane is adjustable continuously and accurately by bending the respective elastic connection member.

A cutting device where the displacement devices each comprise a spring member which is tensionable and relaxable by means of an adjustment drive and interacts with the connection member for pivoting the counter blade allows the position of the counter blades or counter cutting edges to be continuously adjusted in such a way that the gear ratio is increased.

A cutting device where the displacement devices each comprise a reduction gear with an actuation member which converts the rotational movement of an adjustment drive into a linear movement of the actuation member, with the actuation member interacting with the connection member, particularly with the spring member, for pivoting the counter blade ensures a high-precision adjustment of the position of the counter blades or the counter cutting edges. The electrically driven displacement devices comprise a gear reduction which is such that the position of the counter cutting edges is adjustable at a distance to the cutting plane with an accuracy of less than 50 μm, particularly less than 10 μm, and particularly less than 1 μm.

A cutting device where the blades and the counter blades are arranged about the axis of rotation in a rotationally symmetric manner ensures a symmetric load distribution on the cutting spindle as the blades are simultaneously used for cutting. To this end, the number of the blades either needs to be equal to the number of the counter blades or equal to an integral fraction or an integral multiple thereof.

A cutting device where the number of blades is equal to the number of counter blades ensures a simple design of the cutting device.

A cutting device where the counter blades each comprise an oblong hole through which a fastening member is passed in such a way that the counter blades are displaceable along their respective longitudinal axis allows worn-out and sharpened counter blades to be reused. The material abrasion of the counter blades caused by sharpening can be compensated for by displacing said counter blades along their respective longitudinal axis.

A cutting device where the blades each comprise an oblong hole through which a fastening member is passed in such a way that the blades are displaceable along their respective longitudinal axis by means of an adjustment mechanism allows the cutting edges to be positioned in the cutting plane manually or automatically. This applies in particular to the use of sharpened blades as the material abrasion caused by sharpening can be compensated for.

A cutting device where the blades are arranged at an acute angle relative to the cutting plane in such a way that by displacing the blades along their longitudinal axis, the associated cutting edges are displaceable relative to the cutting plane allows the cutting edges to be positioned and adjusted relative to the cutting plane in a simple manner. As the blades are arranged at an acute angle relative to the cutting plane, the cutting edges are also displaceable perpendicularly to the cutting plane by displacing the blades along their longitudinal axis.

A cutting device where the blades are in each case arranged between two clamping members which are positively secured to the cutting spindle in the radial direction ensures a secure and frictional clamping engagement of the blades as the centrifugal forces acting on the blades can be securely absorbed by the clamping members.

A cutting device where the blades each comprise two lateral contact surfaces with a first contact surface abutting against the cutting spindle and a second contact surface abutting against an eccentrically pivotable fastening member allows the blades to be secured to the cutting spindle without clearance.

Further features, details and advantages of the invention will become apparent from the ensuing description of an embodiment.

DESCRIPTION OF THE PREFERRED EMBODIMENT

Figure 1:
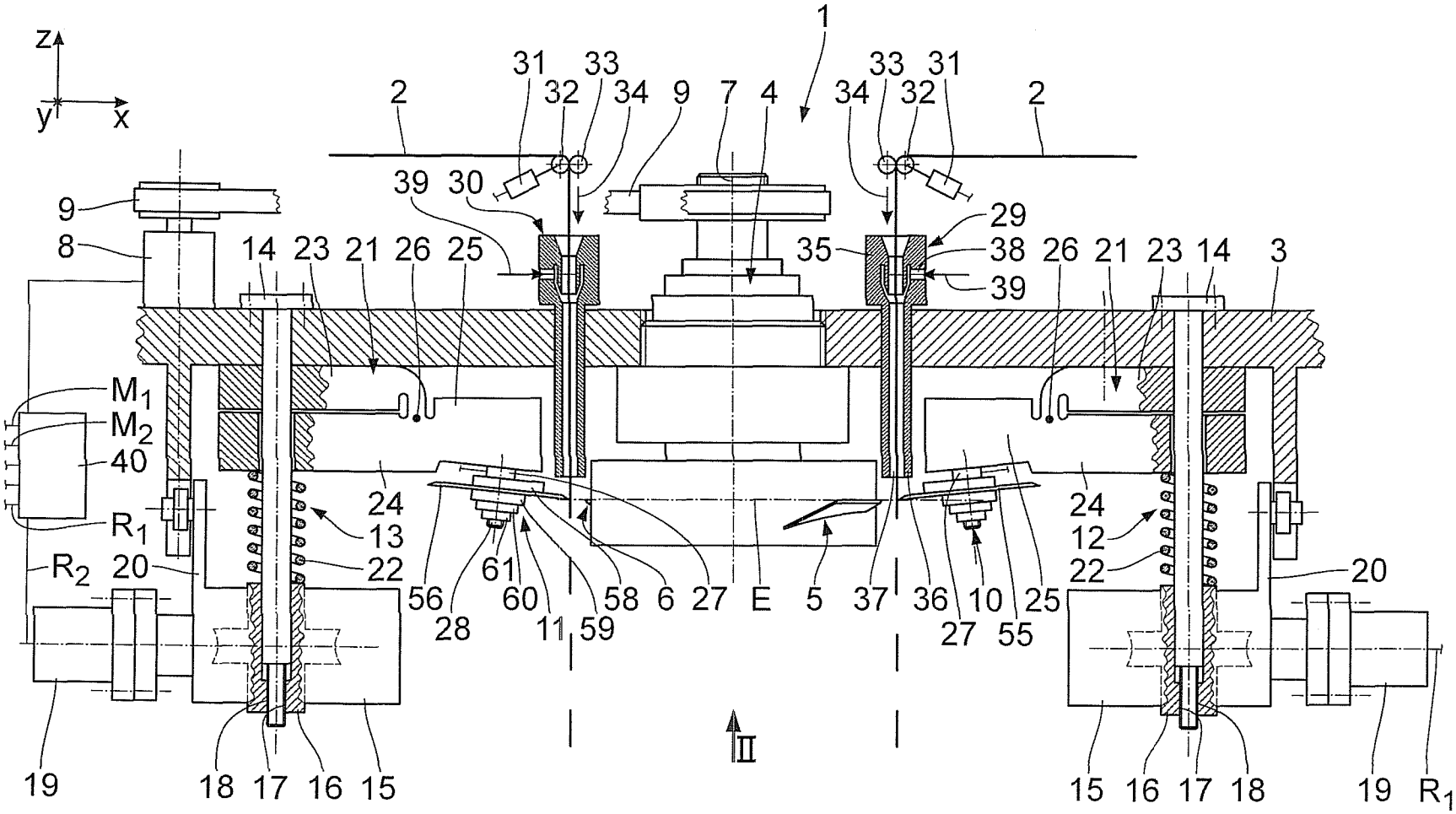
FIG. 1 is a schematic view of a cutting device for shear-cutting of fibre strands comprising two cutting units and counter cutting units arranged in a rotationally symmetric manner.

A cutting device for shear-cutting of endless fibre strands 2 comprises a base frame 3 on which a cutting spindle 4 comprising two cutting units 5 and 6 is arranged. The cutting spindle 4 has an axis of rotation 7 which is parallel to a vertical z-direction. By means of a spindle drive 8, the cutting spindle 4 is rotatably drivable about the axis of rotation 7 via a belt drive 9. The cutting units 5 and 6 are arranged in a rotationally symmetric manner about the axis of rotation 7 at an angle of rotation of 180°. The cutting units 5 and 6 may principally be arranged in a rotationally symmetric manner about the axis of rotation at any desired angle of rotation, for example at an angle of rotation of 120° or 90°. The cutting units 5 and 6 are only outlined in FIG. 1 and will be described in more detail below.

For shear-cutting the fibre strands 2, the cutting device 1 comprises two counter cutting units 10 and 11 which are arranged at associated electrically driven displacement devices 12 and 13. The electrically driven displacement devices 12 and 13 as well as the counter cutting units 10 and 11 are rigidly mounted to the base frame 3 at an angle of rotation of 180° in such a way as to be rotationally symmetric about the axis of rotation 7. The counter cutting units 10 and 11 will be described in more detail below.

The cutting device 1 defines a horizontal cutting plane E which is parallel to an x-direction and a y-direction. The x-, y- and z-directions form a Cartesian coordinate system. The axis of rotation 7 is therefore at right angles to the cutting plane E.

The electrically driven displacement devices 12 and 13 are identical so that only the displacement device 12 will be described below. A torque-proof bolt 14 is passed through the base frame 3, the bolt 14 extending substantially parallel to the axis of rotation 7. The bolt 14 is passed into a reduction gear 15 designed as an angular gear. To this end, the reduction gear 15 comprises an actuation member 16, designed as a hollow shaft, comprising an internal thread 17 to which the bolt 14 is screw-mounted via an external thread 18. The hollow shaft 16 is rotatably drivable about the bolt 14 by means of a electrically driven adjustment drive 19. The reduction gear 15 is secured against rotation by means of a torque support 20 mounted to the base frame 3.

The bolt 14 is passed through a fork-shaped and elastic connection member 21 and through a spring member 22 in the form of a helical spring. The spring member 22 abuts against the hollow shaft 16 and the connection member 21 which in turn abuts against the base frame 3. To this end, the connection member 21 comprises two fork portions 23 and 24 through which the bolt 14 is passed and which abut against the base frame 3 or the spring member 22, respectively. A stem portion 25 is formed in one piece with the fork portions 23, 24 which is pivotable relative to the base frame 3 about a pivot axis 26 extending substantially parallel to the cutting plane E by displacing the fork portion 24 along the bolt 14 relative to the fork portion 23.

The stem portion 25 is provided with a ring-shaped piezoelectric measuring sensor 27. The piezoelectric measuring sensor 27 is arranged between the connection member 21 and the counter cutting unit 10 which is secured to the stem portion 25 by means of a fastening member 28 in the form of an expansion screw. To this end, the fastening member 28 is passed through the ring-shaped measuring sensor 27.

Two fibre supply units 29, 30 are arranged on the base frame 3 for supplying the fibre strands 2 to the cutting units 5, 6 and the counter cutting units 10, 11. The fibre supply units 29, 30 are identical or basically similar so that only the fibre supply unit 29 will be described below.

The fibre supply unit 29 comprises a drive roller 32, which is rotatably drivable by means of a drive motor 31, and an associated pressure roller 33 through which the fibre strand 2 is passed. An injector member 35 and a supply tube 36 are arranged downstream of the rollers 32, 33 in a transport direction 34 of the fibre strand 2. The injector member 35 and the supply tube 36 comprise a common conduit 37 through which the fibre strand 2 can be passed towards the cutting unit 5 or the counter cutting unit 10. The injector member 35 comprises a lateral bore 38 through which conveying air 39 can be supplied to the conduit 37.

The spindle drive 8, the adjustment drives 19, the measuring sensors 27 and the drive motors 31 are connected to a control unit 40 which is used for controlling the cutting device 1.

Each of the cutting units 5, 6 comprises a blade 41, 42 with an associated cutting edge $S_1$, $S_2$. The blades 41, 42 are rotationally symmetric to the axis of rotation 7 and have a common longitudinal axis $L_1$. The blades 41, 42 each comprise an oblong hole 43 extending along the longitudinal axis $L_1$ and are clamped between two clamping members 44, 45 by means of a fastening member 46 in the form of an expansion screw. To this end, the fastening member 46 is passed through the clamping members 44, 45 and the respective oblong hole 43 and is secured to the cutting spindle 4.

Figure 3:
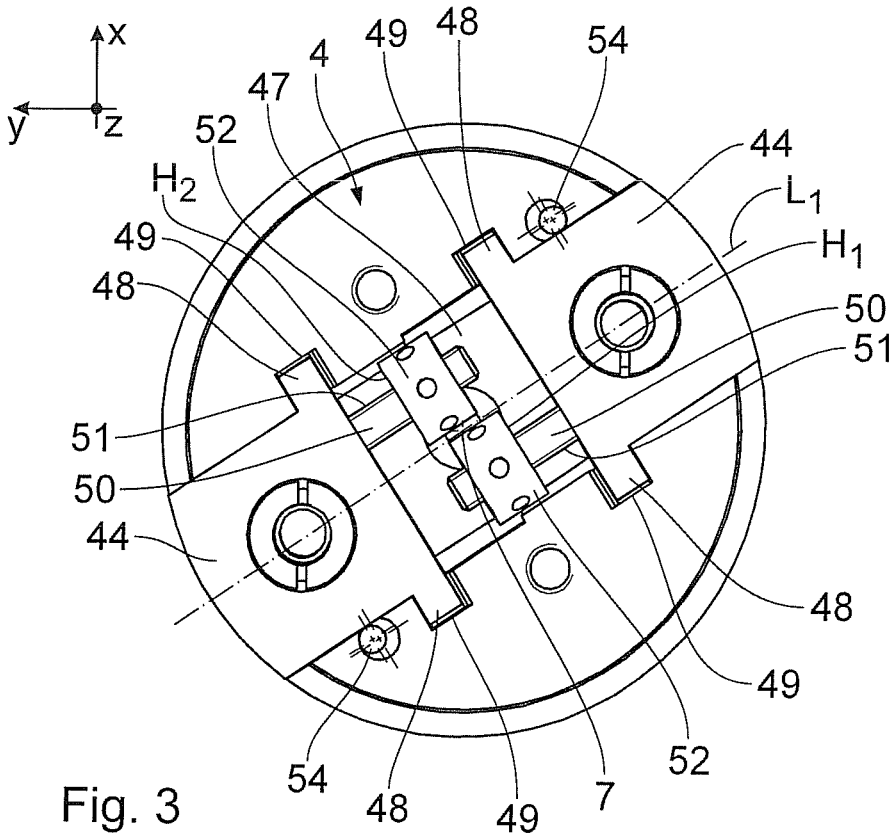
FIG. 3 is a view of the cutting spindle according to FIG. 2 without blades.

As can be seen in FIG. 3, the clamping members 44 are arranged in a groove 47 of the cutting spindle 4. The clamping members 44 are T-shaped and comprise retaining members 48 which are positively arranged in retaining grooves 49 in such a way that the clamping members 44 are secured in the radial direction. The clamping members 44 each comprise an adjustment bolt 50 which is parallel to the longitudinal axis $L_1$ and comprises an external thread 51 to which an adjustment nut 52 is screwed. The adjustment nuts 52 comprise associated adjustment surfaces $H_1$, $H_2$ with which the blades 41, 42 are in contact and towards which the blades 41, 42 are displaceable by turning the adjustment nuts 52. The adjustment bolts 50 and the associated adjustment nuts 52 thus form an adjustment mechanism for the position of the blades 41, 42 clamped between the clamping members 44, 45.

Figure 2:
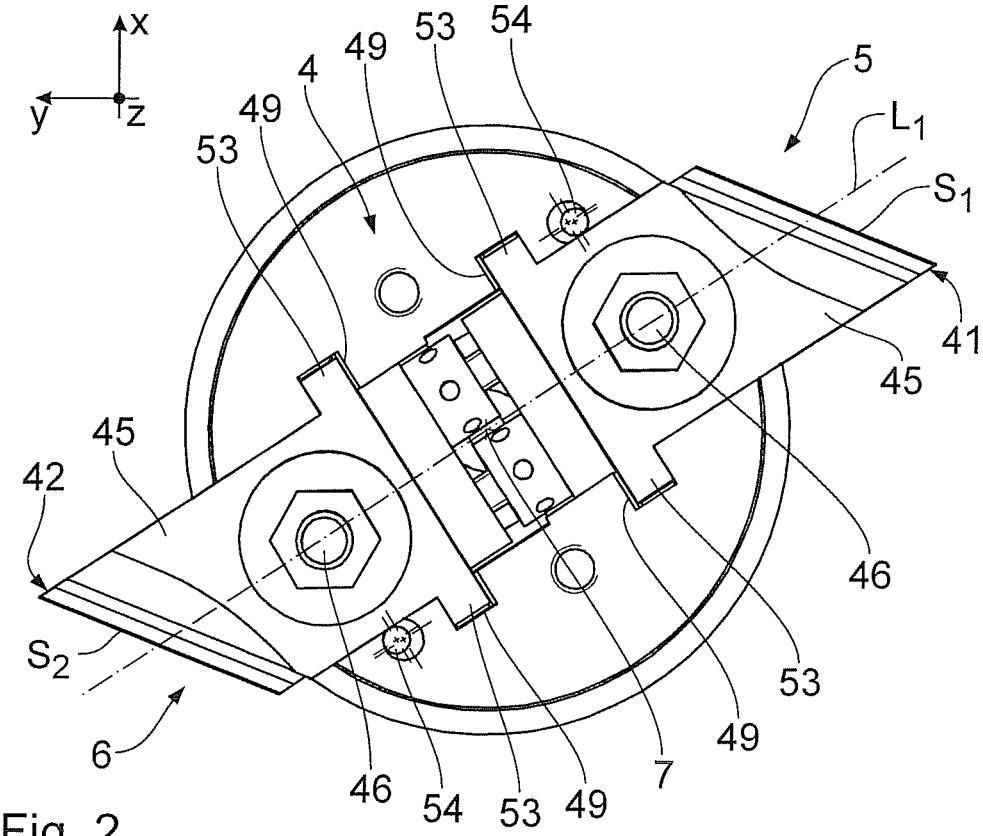
FIG. 2 is a view of a cutting spindle of the cutting device in the direction of the arrow II in FIG. 1.

As can be seen from FIG. 2, the clamping members 45 comprise retaining members 53 corresponding to the clamping members 44 which are also positively arranged in the retaining grooves 49.

A first contact surface $A_1$ of each of the blades 41, 42 abuts against the cutting spindle 4, a second contact surface $A_2$ abuts against an eccentrically pivotable fastening member 54, and a third contact surface $A_3$ abuts against the respective adjustment surface $H_1$, $H_2$ of the adjustment nuts 52.

The counter cutting units 10, 11 each comprise a counter blade 55, 56 with an associated counter cutting edge $G_1$, $G_2$. The counter blades 55, 56 each comprise an oblong hole 57 which extends in the direction of the respective longitudinal axis $L_2$, $L_3$ of the counter blades 55, 56. The longitudinal axes $L_2$ and $L_3$ of the counter blades 55, 56 are parallel to each other. The counter blades 55, 56 are clamped between two clamping members 58, 59 which are mounted to the respective fastening member 28 by means of a clamping force distributor 60 and a fastening nut 61. The clamping members 58 are laterally secured by means of contact pins 62 which are in contact with a first contact surface $A_4$ of the counter blades 55, 56. A second contact surface $A_5$ of the counter blades 55, 56 is in contact with an eccentrically pivotable fastening member 63.

Figure 4:
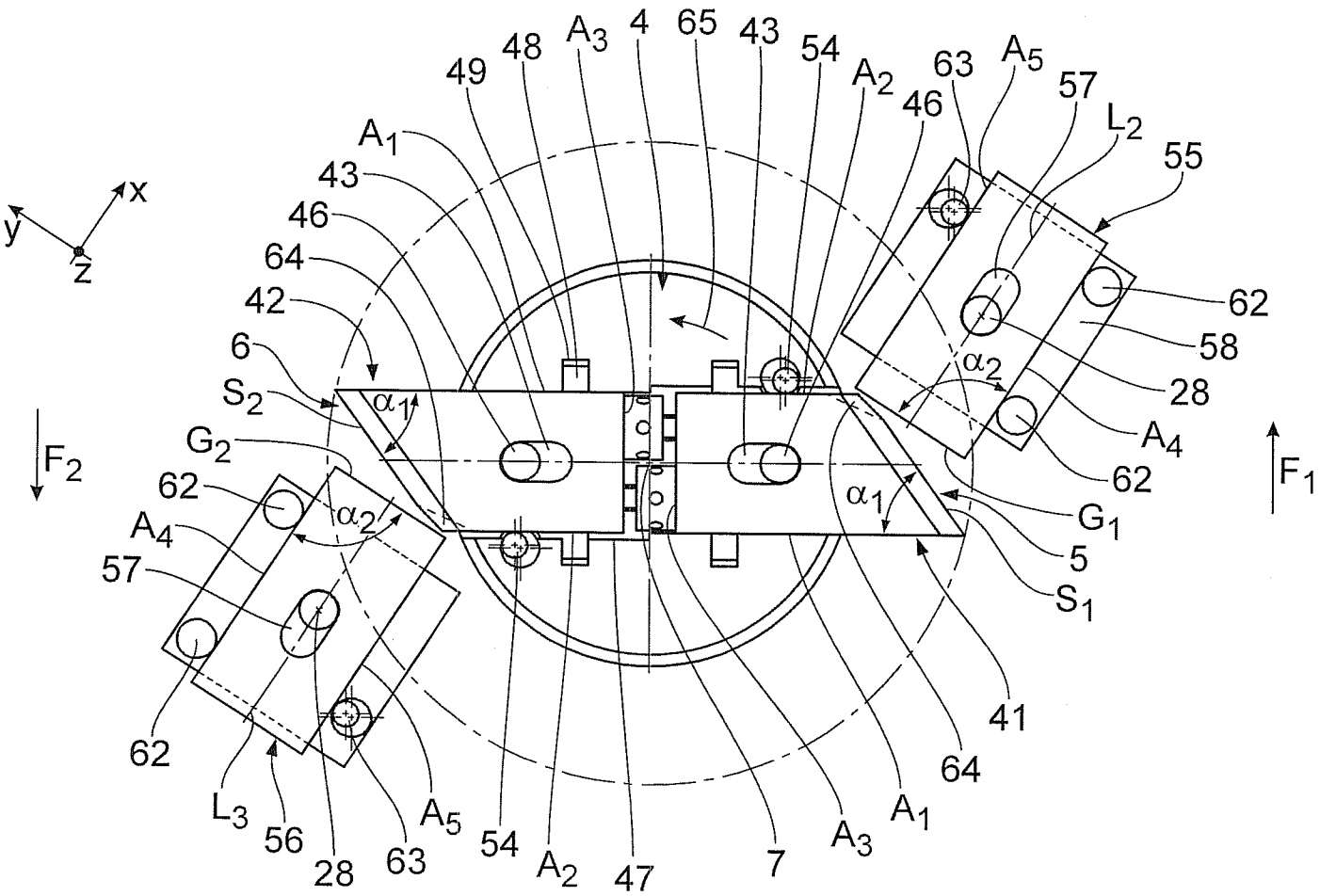
FIG. 4 is a view of the cutting spindle according to FIG. 2 with blades and associated counter blades.
Figure 5:
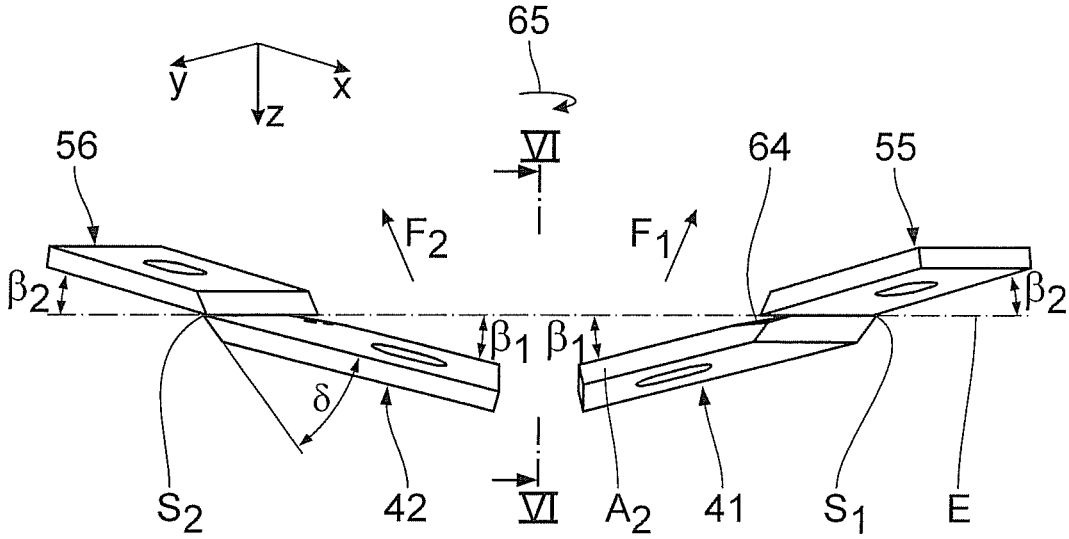
FIG. 5 is a schematic side view of the blades and associated counter blades according to FIG. 4.
Figure 6:
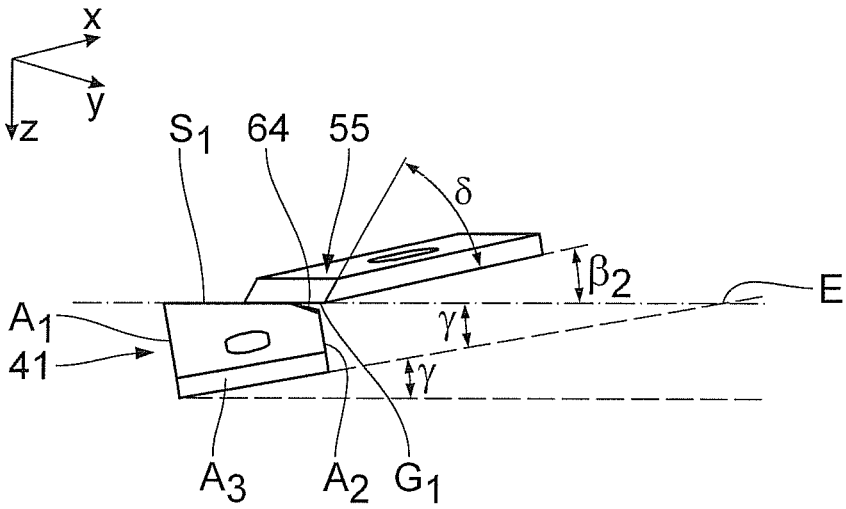
FIG. 6 is a view of a blade and an associated counter blade in the direction of the arrows VI in FIG. 5.

FIGS. 4 to 6 illustrate the positions of the blades 41, 42 and of the counter blades 55, 56 relative to each other and to the cutting plane E. In order to perform a scissor-like cut, the counter blades 55, 56 are arranged in such a way that their longitudinal axes $L_2$, $L_3$ are preferably parallel to the x-direction and evenly spaced from the axis of rotation 7. The blades 41, 42 have a cutting edge angle $\alpha_1$ which is smaller than 90° whereas the counter blades 55, 56 have a cutting edge angle $\alpha_2$ which is preferably equal to 90°. The clamping members 44 form an oblique plane for the blades 41, 42 in such a way that the blades 41, 42 in each case form a clearance angle $\beta_1$ with the cutting plane E relative to the upper edge of the contact surfaces $A_2$, the clearance angle $\beta_1$ being acute. The clearance angle $\beta_1$ is in particular smaller than 20°, in particular smaller than 5°, and in particular smaller than 2°. In order for the cutting edges $S_1$, $S_2$ to run parallel to the cutting plane E or in the cutting plane E, the blades 41, 42 also need to be inclined relative to the cutting plane E through an adjustment angle $\gamma$ with respect to the lower edge of the contact surface $A_3$. Moreover, the blades 41, 42 comprise chamfers 64 which are arranged in a direction of rotation 65 of the cutting spindle 4 in a front region of the cutting edges $S_1$, $S_2$ to prevent the blades 41, 42 from locking with the counter blades 55, 56. The counter blades 55, 56 form a clearance angle $\beta_2$ with the cutting plane E and the lower edge of the contact surfaces $A_4$ or $A_5$, the clearance angle $\beta_2$ being acute as well. The counter cutting edges $G_1$, $G_2$ of the counter blades 55, 56 are provided with a wedge angle $\delta$ relative to the lower edge of the contact surfaces $A_4$, $A_5$, the wedge angle $\delta$ being smaller than 90°. Correspondingly, the same applies to the blades 41, 42.

The measuring sensors 27 are arranged between the respective clamping member 58 and the respective connection member 21. The measuring sensors 27 are three-dimensional, allowing an x-component, a y-component and a z-component of a force $F_1$ or $F_2$, respectively, acting on the counter blades 55, 56 or counter cutting edges $G_1$, $G_2$, respectively, to be measured by means of the measuring sensors 27. The forces $F_1$ and $F_2$ are shown by example in FIGS. 4 and 5. The measuring sensors 27 generate a measuring signal $M_1$ or $M_2$, respectively, corresponding to the forces $F_1$ and $F_2$, which are then transmitted to the control unit 40. The control unit 40 is configured in such a way that depending on the associated measuring signal $M_1$, $M_2$, control signals $R_1$, $R_2$ are generatable by means of which the electrically driven displacement devices 12, 13 are actuable so that the counter cutting edges $G_1$, $G_2$ are displaceable relative to the cutting plane E.

Prior to commissioning of the cutting device 1, the cutting edges $S_1$, $S_2$ and the counter cutting edges $G_1$, $G_2$ need to be adjusted with respect to the common cutting plane E. The cutting edge $S_1$ is for example used as reference cutting edge which defines the position of the cutting plane E. In a first step, the blades 41, 42 and counter blades 55, 56 are positioned relative to each other as close as possible so that the cutting edge $S_2$ and the counter cutting edges $G_1$, $G_2$ are disposed as close as possible to the cutting plane E. While the cutting spindle 4 is slowly rotating, the adjustment drive 19 is then used to move the counter cutting edge $G_1$ of the counter blade 55 in the direction of the cutting edge $S_1$ until the cutting edge $S_1$ is in contact with the counter cutting edge $G_1$. The contact is detectable via the measuring sensor 27. The corresponding angular position of the adjustment drive 19 is stored in the control unit 40.

The cutting edge $S_2$ is then moved towards the counter cutting edge $G_1$ in an oscillating manner, and the counter cutting edge $G_1$ is moved in the direction of the cutting edge $S_2$ by means of the adjustment drive 19 until the counter cutting edge $G_1$ is in contact with the cutting edge $S_2$. The contact is again detectable by means of the measuring sensor 27. The corresponding angular position of the adjustment drive 19 is stored in the control unit 40. The angle difference between the two angular positions of the adjustment drive or the corresponding path difference may then be used to calculate the necessary displacement path of the blade 42, which is adjusted by means of the associated adjustment nut 52, along the oblique plane of the clearance angle $\beta_1$ which is required for the cutting edges $S_1$ and $S_2$ to come to rest in the cutting plane E. After this manual correction of the position of the cutting edge $S_2$, the adjustment error is detected as described above and compared to a permissible adjustment tolerance. If the error is within the adjustment tolerance, adjustment of the cutting edges $S_1$ and $S_2$ is finished; if not, the adjustment process described above is repeated.

After the adjustment process of the cutting edges $S_1$ and $S_2$ is finished, the counter cutting edges $G_1$ and $G_2$ are moved, by means of the associated adjustment drives 19, in the direction of the cutting edges $S_1$ and $S_2$ until they are in contact with each other. The contact is detectable using the measuring sensors 27.

After positioning the cutting edges $S_1$, $S_2$ and the counter cutting edges $G_1$, $G_2$ in the cutting plane E, the cutting device 1 may now be put into operation. The fibre supply units 29, 30 are used to transport for example two fibre strands 2 to the counter cutting units 10, 11. Transport of the fibre strands 2 is performed using the drive rollers 32 and the conveying air 39 flowing in the supply tubes 36. The fibre strands 2 are thus transported in a drawing manner, with the conveying air 39 cooling the cutting edges $S_1$, $S_2$ and the counter cutting edges $G_1$, $G_2$ at the same time. The endless fibre strands 2 are for example drawn off fibre strand spools (not shown). The drive motors 31 allow the drive rollers 32 to be driven in a speed-controlled manner, with the result that the fibre strand speed, and therefore the fibre strand throughput, is adjustable. The fibre length to be cut is determined by means of the corresponding spindle speed.

It is conceivable as well to supply several fibre strands 2 to each counter blade 55, 56 via in each case a common supply tube 36 or via several separate supply tubes 36 for each fibre strand 2.

In order to obtain a continuously good cut quality for the highly viscous fibre strands 2, the position of each of the counter blades 55, 56 relative to the rotating blades 41, 42 is adjusted in a narrow tolerance range. This allows thermal changes in the cutting device 1 and/or a wear of the blades 41, 42 or the counter blades 55, 56 to be compensated.

The measuring sensors 27 are used to determine a z-component of the force $F_1$ or $F_2$, respectively, acting on the respective counter blade 55, 56 or counter cutting edge $G_1$, $G_2$ in the z-direction during a cutting process. The forces acting in the z-direction are hereinafter referred to as z-forces $F_1(z)$ and $F_2(z)$. These forces correspond to the respective spreading force between the contacting blades 41, 42 and counter blades 55, 56. A measuring signal $M_1$, $M_2$, which corresponds to the z-forces $F_1(z)$ and $F_2(z)$, is transmitted to the control unit 40. The control unit 40 evaluates the measuring signals $M_1$, $M_2$ and compares them to a predetermined nominal spreading force value. Depending on the comparison results, adjustment signals $R_1$ and $R_2$ are generated for and transmitted to the adjustment drives 19 of the displacement devices 12, 13. The adjustment drives 19 are positioned according to the actuation signals $R_1$ and $R_2$, with the associated actuation member 16 being displaced linearly via the respective reduction gear 15. The linear displacement causes the associated spring member 22 and the associated connection member 21 to be tensioned or relaxed so that the stem portions 25 are pivoted about the associated pivot axes 26 and the counter cutting edges $G_1$, $G_2$ are displaced relative to the cutting plane E. The measuring sensors 27 and the displacement devices 12, 13 thus form control circuits for the counter cutting edges $G_1$, $G_2$.

Furthermore, the measuring sensors 27 determine an x-component, acting in the x-direction, and a y-component, acting in the y-direction, of the forces $F_1$ and $F_2$ acting on the counter blades 55, 56 during a cutting process. The x-component as well as the y-component of the respective force $F_1$ and $F_2$, respectively, are hereinafter referred to as x-force $F_1(x)$ or $F_2(x)$, respectively, and y-force $F_1(y)$ or $F_2(y)$, respectively. The x-force $F_1(x)$, $F_2(x)$ and/or the y-force $F_1(y)$, $F_2(y)$ correspond to a cutting force acting on the respective counter blade 55, 56 during the cutting process. These forces can therefore be used for detecting a wearing-out or blunt cutting edge $S_1$, $S_2$ or counter cutting edge $G_1$, $G_2$.

The gear reduction of the respective adjustment drive 19 via the reduction gear 15, the pitch of the external thread 18, the stiffness of the spring member 22 and of the elastic connection member 21 including its lever ratio are selected in such a way that the position of the associated counter cutting edge $G_1$, $G_2$ is adjustable within a fraction of a micrometer.

The fibre strands 2 are cut into pieces of a desired length between the counter cutting edges $G_1$ and $G_2$ and the cutting edges $S_1$, $S_2$ rotating along the counter cutting edges $G_1$, $G_2$. The length of the pieces is adjustable via the rotational speed of the cutting spindle 4 and/or via the speed of the fibre strands 2.

When the cutting edges $S_1$, $S_2$ or counter cutting edges $G_1$, $G_2$ are wearing out, a higher spreading force is required to reach the desired cut quality so the continuous spreading force increase may for example be compensated for by the number of blade contacts and/or an image-processing cut quality evaluation and/or a cutting force evaluation in order to achieve a stable and continuously good adjustment until the blade needs to be replaced.

Based on a corresponding nominal angle, permissible deviation limits for the cutting angles $\alpha_1$, $\alpha_2$ may only be negative so as to obtain a tolerance-related spreading force increase in the direction of the outlet while the blades are in contact.

The cutting spindle 4 is preferably driven via the belt drive 9 as this allows several cutting spindles 4 to be driven via a common spindle drive 8. Alternatively, the cutting spindle may be driven via a direct drive which is not shown.

In the cutting device 1 according to the invention, the blades 41, 42 as well as the counter blades 55, 56 can thus be displaced and positioned in the cutting plane E independently of each other. The position of the counter blades 55, 56 is controlled by means of the measuring sensors 27 and the electrically driven displacement devices 12, 13.

What is claimed is:

1. A cutting device for shear-cutting of fibre strands comprising a base frame;

at least two cutting units;

which comprise in each case a blade with a cutting edge, with a first cutting edge defining a cutting plane; and a second cutting edge being displaceable and positionable in the cutting plane independently of the first cutting edge;

which are arranged at a cutting spindle mounted to the base frame, the cutting spindle being rotatably drivable about an axis of rotation which is perpendicular to the cutting plane;

at least two counter cutting units;

which comprise in each case a counter blade with a counter cutting edge, with the counter cutting edges being displaceable and positionable in the cutting plane independently of each other by means of a respective electrically driven displacement device; and a force acting on the respective counter cutting edge being detectable as a measuring signal by means of a respective measuring sensor; and which are rigidly arranged at the base frame about the axis of rotation;

at least two fibre supply units for supplying fibre strands between the at least two cutting edges and the respectively associated counter cutting edges; and a control unit which is configured in such a way that depending on the associated measuring signal, each of the counter cutting edges is displaceable relative to the cutting plane by means of the respective electrically driven displacement device.

2. A cutting device according to claim 1, wherein the measuring sensors are piezoelectric.

3. A cutting device according to claim 1, wherein by means of the measuring sensors, a force is measurable which acts on a respective one of the counter blades in the z-direction, with the z-direction being perpendicular to the cutting plane.

4. A cutting device according to claim 1, wherein by means of the measuring sensors, a force is measurable which acts on a respective one of the counter blades in at least one of an x-direction and a y-direction, with the x- and y-directions being parallel to the cutting plane.

5. A cutting device according to claim 1, wherein the measuring sensors are in each case arranged between the counter blade and the electrically driven displacement device.

6. A cutting device according to claim 1, wherein the displacement devices each comprise a fork-shaped and elastic connection member to which the respective counter blade is mounted and displaceable relative to the base frame about a pivot axis.

7. A cutting device according to claim 6, wherein the displacement devices each comprise a spring member which is tensionable and relaxable by means of an adjustment drive and interacts with the connection member for pivoting the counter blade.

8. A cutting device according to claim 6, wherein the displacement devices each comprise a reduction gear with an actuation member which converts the rotational movement of an adjustment drive into a linear movement of the actuation member, with the actuation member interacting with the connection member for pivoting the counter blade.

9. A cutting device according to claim 8, wherein the actuation member interacts with the spring member for pivoting the counter blade.

10. A cutting device according to claim 1, wherein the blades and the counter blades are arranged about the axis of rotation in a rotationally symmetric manner.

11. A cutting device according to claim 1, wherein the number of blades is equal to the number of counter blades.

12. A cutting device according to claim 1, wherein the counter blades each comprise an oblong hole through which a fastening member is passed in such a way that the counter blades are displaceable along their respective longitudinal axis.

13. A cutting device according to claim 1, wherein the blades each comprise an oblong hole through which a fastening member is passed in such a way that the blades are displaceable along their respective longitudinal axis by means of an adjustment mechanism.

14. A cutting device according to claim 1, wherein the blades are arranged at an acute angle relative to the cutting plane in such a way that by displacing the blades along their longitudinal axis, the associated cutting edges are displaceable relative to the cutting plane.

15. A cutting device according to claim 1, wherein the blades are in each case arranged between two clamping members which are positively secured to the cutting spindle in the radial direction.

16. A cutting device according to claim 1, wherein the blades each comprise two lateral contact surfaces with a first contact surface abutting against the cutting spindle and a second contact surface abutting against an eccentrically pivotable fastening member.

* * * * *